United States Patent [19]

Jachowski et al.

[11] 4,423,398

[45] Dec. 27, 1983

[54] INTERNAL BI-METALLIC TEMPERATURE COMPENSATING DEVICE FOR TUNED CAVITIES

[75] Inventors: Ronald E. Jachowski, Paradise Valley, Ariz.; Louis E. Brown, Dallas, Tex.

[73] Assignee: Decibel Products, Inc., Dallas, Tex.

[21] Appl. No.: 306,077

[22] Filed: Sep. 28, 1981

[51] Int. Cl.[3] ..... H01P 7/04; H01P 7/06; H01P 1/202; H01P 1/207

[52] U.S. Cl. ..... 333/229; 333/223; 333/231; 333/234

[58] Field of Search ..... 333/219–224, 333/227, 229–235, 202, 206–209, 228, 245, 248

[56] References Cited

U.S. PATENT DOCUMENTS

| | | | |
|---|---|---|---|
| 3,252,116 | 12/1966 | Painter | 333/229 |
| 3,873,949 | 3/1975 | Dorsi et al. | 333/234 |
| 4,057,772 | 11/1977 | Basil, Jr. et al. | 333/234 |

*Primary Examiner*—Marvin L. Nussbaum
*Attorney, Agent, or Firm*—Cahill, Sutton & Thomas

[57] ABSTRACT

A microwave tuned cavity has a strip of temperature sensitive bi-metallic material plated with silver attached at one end to the inner surface for the tuned cavity and having its other end extending at an inclined angle to the center of the volume bounded by the inner surface of the tuned cavity. The housing of the tuned cavity expands as its temperature increases, tending to cause the resonant frequency of the cavity to decrease. The strip of bi-metallic material bends slightly as the temperature increases, causing its free end to move toward the surface on which the strip is mounted. This decreases the amount of capacitive loading of the resonant signal in the cavity, tending to increase the resonant frequency caused by thermal expansion of the housing. When the temperature decreases, the free end of the bi-metallic strip moves slightly toward the center of the cavity, thereby compensating for slight thermal contraction of the walls due to the decrease in temperature. In another embodiment of the invention, the bi-metallic strip is attached to the inner surface of a coaxial cavity to compensate for variation in the length of a coaxial resonator as its temperature varies.

11 Claims, 10 Drawing Figures

INTERNAL BI-METALLIC TEMPERATURE COMPENSATING DEVICE FOR TUNED CAVITIES

BACKGROUND OF THE INVENTION

Tuned cavities are widely used in microwave communications applications. Coaxial cavities, square prism filters, and cubical "multiple cavity" devices such as those disclosed in commonly owned U.S. Pat. No. 4,249,148, are commonly used to implement bandpass filters, notched filters, composite filters, and combiners. Temperature compensating such tuned cavities for thermal expansion and contraction of housings or internal resonators of tuned cavities so that their resonant frequencies remain constant as their temperatures vary has generally been accomplished by manufacturing the housings of a material commonly known as Invar. Invar is a metallic compound having a very low positive temperature coefficient, and does not expand as temperature increases nearly as much as copper. However, the electrical conductivity of Invar is far too low for it to be satisfactory as the inner surface material of a tuned cavity, which inner surface must have an extremely high electrical conductivity to provide satisfactory performance. Therefore, temperature compensated square prism filters or cubic filters usually have their interior Invar surfaces gold plated in order to provide the required high conductivity. The necessity of providing gold plated inner surfaces obviously is very expensive. Furthermore, as the need for economical high "Q" tuned cavities has increased in the microwave art, it has been sometimes necessary to increase the volume, and thus, the interior surface area of tuned cavities, thereby increasing the cost of gold plating the interior surface area.

Coaxial tuned cavity devices have been made relatively temperature insensitive by using threaded Invar tuning rods in the construction of adjustable length, copper sleeve-type resonators, the length of which determines the resonant frequency. However, in some instances, even the slight change in length of the Invar tuning rods causes unacceptable variation in resonant frequency with temperature changes, and expensive, inconvenient techniques such as attaching the upper end of the Invar rod to a large bracket attached to the top of the cylindrical housing are used to physically counteract the temperature variation in the length of the Invar rod as the temperature changes.

Another approach to temperature compensating of tuned cavities that has been used is to provide a suitable bi-metallic coil on the outer surface of a tuned cavity so that a free end of the bi-metallic coil controls the amount of insertion of a conductive probe extending through the wall of the tuned cavity and into the internal volume thereof. As the temperature of the bi-metallic coil increases, it causes the conductor to tend to move out of the interior volume, decreasing capacitive loading of the resonant signal in the tuned cavity, thereby tending to offset the decrease in frequency caused by expansion of the frequency determining components (i.e., the walls of a square prism filter or the resonator of a coaxial filter) of the tuned cavity. However, this approach has been found to be unreliable, for two reasons. First, it has been very difficult to provide the needed high conductivity electrical path from the probe to the inner surface of the tuned cavity. Second, friction between the probe and the wall of the counter as the probe slides through a hole in the wall causes the inward and outward movement to be erratic, causing erratic and inaccurate temperature compensation.

Thus, there remains an unmet need for a simple, low cost, highly reliable, and accurate temperature compensated tuned cavity.

Accordingly, it is an object of the invention to provide an accurately temperature compensated tuned cavity that does not need to have its frequency determining parts composed of Invar metal.

It is another object of the invention to avoid the necessity of plating the interior of a tuned cavity device with gold or other high conductivity metal.

It is another object of the invention to provide a low cost, reliable temperature-stable microwave resonant device with temperature compensating elements located within the resonant device.

It is another object of the invention to provide an improved means for both calibrating and temperature compensating a tuned cavity device.

SUMMARY OF THE INVENTION

Briefly described, and in accordance with one embodiment thereof, the invention provides a tuned cavity with a bi-metallic element and a high conductivity surface that is electrically connected to the inner surface of the tuned cavity and extending into the interior volume of the tuned cavity from the inner surface thereof to extend further into the interior volume as the temperature decreases and to extend less deeply into the interior volume as the temperature increases to cause capacitive loading of the resonant signal in the tuned cavity which compensates for thermal expansion and contraction of the frequency-determining parts of the tuned cavity. In the described embodiments of the invention, the bi-metallic strip is coated with the high conductivity surface, is relatively small in size, and extends from a highly conductive inner surface of the tuned cavity into a region where the electric field intensity is relatively high. In one embodiment of the invention, the bi-metallic strip has a short base tab that is attached to the inner surface of a square prism filter with copper walls. A long section of the bi-metallic strip is substantially straight and is inclined at a roughly 30° angle relative to the interior surface to which the bi-metallic strip is attached. The bi-metallic strip is plated with silver to minimize insertion loss. In another embodiment of the invention, a cubic "multiple cavity" device of the type described in commonly owned U.S. Pat. No. 4,249,148, has a plurality of such bi-metallic, silver plated strips attached to mutually perpendicular inner surfaces of the cubic tuned cavity device. In another embodiment of the invention, a similar silver plated bi-metallic strip is attached to the inner wall of the coaxial tuned cavity adjacent to the inner end of the resonator of the coaxial tuned cavity.

In another embodiment of the invention, a small adjustment screw extends through a threaded hole in the housing of a tuned cavity to engage the inclined bi-metallic strip portion attached to the inner surface of the cavity. The resonant frequency of the cavity is calibrated by turning the screw, which "spring biases" the portion of the bi-metallic strip extending into the interior of the tuned cavity. In another embodiment of the invention, the housing of a tuned cavity has an elongated slot. A bi-metallic strip that is attached to a highly conductive slide plate disposed on the outer surface of the housing extends through the elongated slot into the tuned cavity. The lateral position of the bi-metallic element is controlled by moving the bi-metallic element along the axis of the elongated slot.

DESCRIPTION OF THE INVENTION

Figure 1:
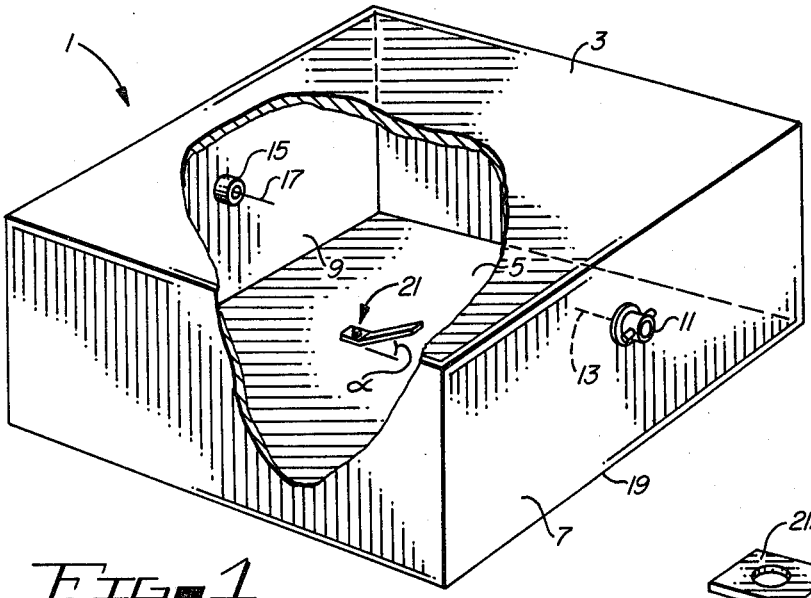
FIG. 1 is a perspective partial cutaway view of a square prism filter embodying the temperature compensating, inclined bi-metallic element of the present invention.

Referring now to the drawings, particularly FIG. 1, square prism filter 1 includes two major opposed faces 3 (top face) and 5 (bottom face) and also includes two rectangular end faces 7 and 9. The front and rear faces have the same dimensions as end faces 7 and 9. The top and bottom faces 3 and 5 are square. Those skilled in the art know that the height of square prism filter 1 determines its "Q" and the length dimension of the rectangular faces determines the resonant frequency of the tuned cavity.

The front and rear faces, right and left faces, and top and bottom faces of square prism filter 1 are all composed of copper or other highly conductive material such as aluminum, because of its very high electrical conductivity. A coaxial feedthrough connecter 11 is connected on the geometric center of the outer surface of right side 7. An electric field probe 13 extends through a small hole in right side 7 into the interior volume of square prism filter 1. A similar coaxial connector and electric field probe 17 are disposed on the left side 9, as shown in FIG. 1.

Since the dimension of edge 19 determines the resonant frequency of square prism filter 1, and since the most economical suitable high conductivity materials have a relatively large thermal expansion coefficients, the "natural" resonant frequency of square prism filter 1 decreases as the temperature increases.

In order to temperature compensate this decrease in the resonant frequency of square prism filter 1, a bi-metallic temperature compensating element 21 is attached to the inner surface of bottom 5, as shown in the cutaway view of FIG. 1.

Figure 1A:
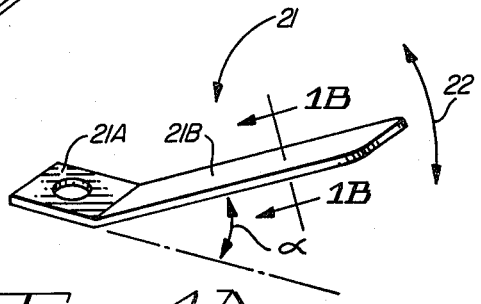
FIG. 1A is a perspective view of the bi-metallic temperature compensating element of the present invention.

The structure of bi-metallic temperature compensating element 21 can be better seen by referring to FIG. 1A, whereas it is seen that bi-metallic temperature compensating element 21 has the structure of an elongated strip having a flat, roughly square base section 21A and a relatively straight, flat inclined section 21B. In a typical application, such as 800 megahertz square prism filter, the width of the strip may be roughly one-fourth of an inch, and the length of inclined section 21B can be approximately two inches. Its thickness is approximately one-thirty-second of an inch. Its angle of inclination $\alpha$ is approximately 30°.

A wide variety of temperature sensitive bi-metallic material is commercially available. In the described embodiment of the invention, bi-metallic material, manufactured by Chace Metals, Inc. in North Carolina was utilized.

It is necessary that the surface of temperature compensating element 21 has extremely high electrical conductivity, in order to avoid excessive insertion loss that occurs when low conductivity elements are inserted into a tuned cavity. Since the above-mentioned bi-metallic materials do not have high electrical conductivity, the bi-metallic material 21′ (shown in FIG. 1B) is plated with a thin layer 21′ of silver or other suitable high conductivity material. As is well known, the bi-metallic portion 21′ includes two adjacent, attached layers of two metals of differing thermal expansion coefficients, so that slight bending occurs as the temperature varies.

A small hole is shown in the center of base section 21A (FIG. 1A) to facilitate attaching temperature compensating device 21 to the interior of an appropriate side of square prism filter 1 by means of a suitable screw.

Experiments have shown that the free end of inclined section 21B moves several mils relative to the plane of the inner cavity surface to which base 21A is attached as the temperature of the cavity varies from approximately −30° C. to +70° C. This has been found to be sufficient to very accurately temperature compensate the square prism filter 1 over that temperature range such that the resonant frequency of the cavity remains essentially independent of temperature, if the temperature compensating device 21 is mounted as shown in FIG. 1.

However, it has been experimentally found that the temperature compensating element can be attached to numerous points of the inner surface of square prism filter 1 to still obtain relatively good temperature compensating results. The electric field intensity has been found to be greatest at the geometric centers of the upper surface 3 and the lower surface 5 of square prism filter 1, resulting in sufficient de-tuning of the device with a minimum sized temperature compensating element. If temperature compensating element 21 is placed in a corner of one of the sides of square prism filter 1, for example, a longer inclined section 21B will be required to achieve complete temperature compensation necessary to result in a constant resident frequency. Although this might be satisfactory, somewhat greater insertion loss would occur than if the temperature compensating element is optimally positioned.

Figure 1B:
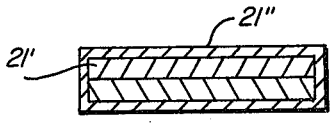
FIG. 1B is a section view taken along section line 1B—1B of FIG. 1A.
Figure 2:
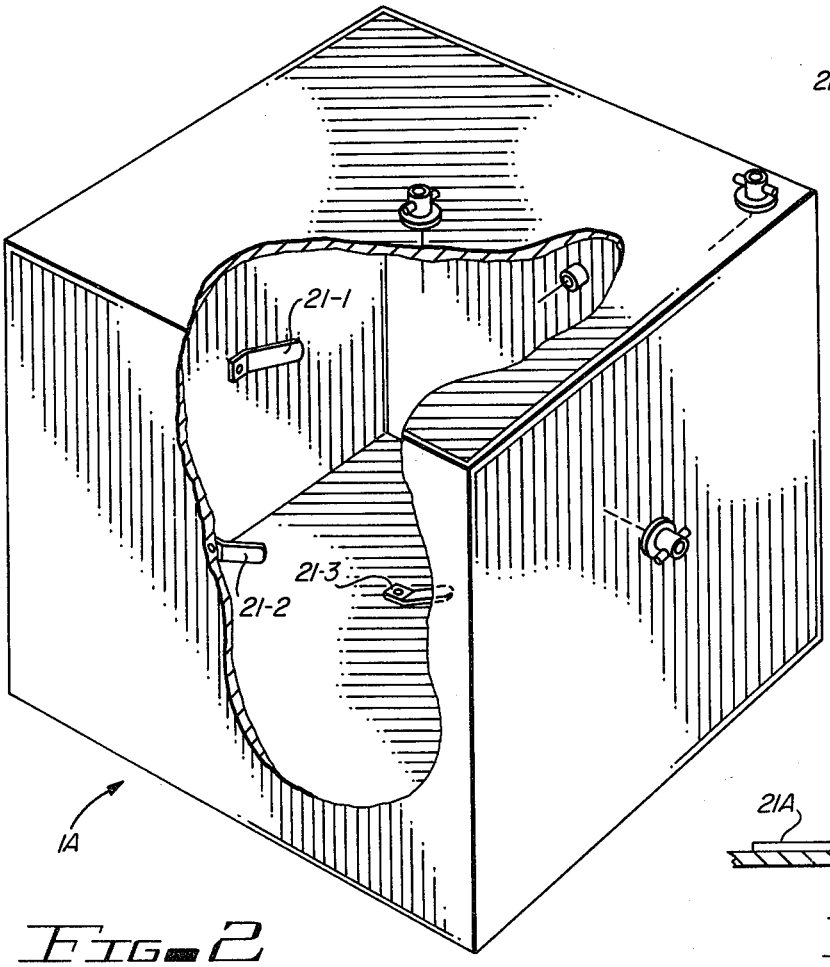
FIG. 2 is a perspective view of a cubic "multiple cavity" tuned cavity device having a plurality of inclined bi-metallic temperature compensating elements of the present invention attached to mutually perpendicular inner surfaces of the cubic tuned cavity.

The temperature compensating element shown in FIGS. 1A and 1B also can be utilized in cubic structure "multiple cavity" tuned devices such as the one described in my issued U.S. Pat. No. 4,249,148, assigned to the present assignee and incorporated herein by reference. For example, in FIG. 2, cubic filter 1A has three temperature compensating devices such as 21 attached to the inner surfaces of three mutually perpendicular sides of the cubic structure 1A. More specifically, temperature compensating element 21-1 is centrally attached to the left side of cubic filter 1A; temperature compensating element 21-2 is attached to the center of the inner surface of the front side of cubic filter 1A, and temperature compensating element 21-3 is attached to the center of the inner surface of the bottom side of cubic filter 1A. Their operation is entirely similar to that previously described.

Figure 3B:
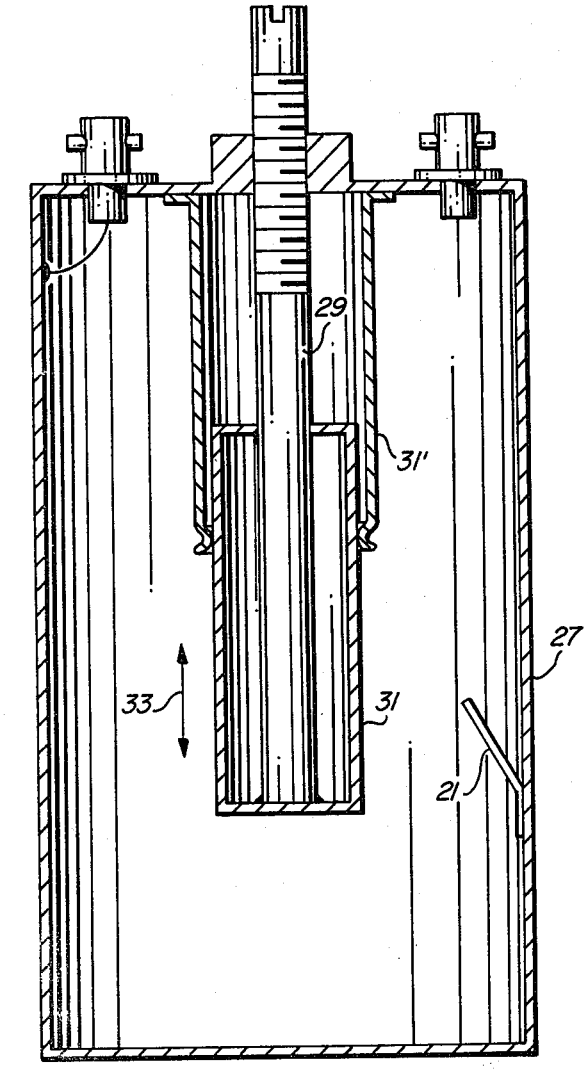
FIG. 3B is a section view taken along section line 3B—3B of FIG. 3A.
Figure 3A:
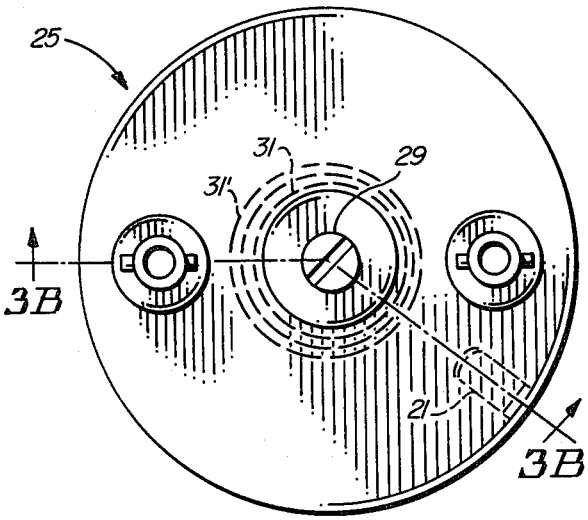
FIG. 3A is a top view of a coaxial tuned cavity incorporating the temperature compensating bi-metallic element of the present invention.

Referring now to FIGS. 3A and 3B, a conventional coaxial tuned cavity 25 is shown, its top view being disclosed in FIG. 3A, and a sectional view through section line 3B—3B being shown in FIG. 3B. The housing 27 is typically composed of aluminum or copper. The surface of resonator rod 31 typically is composed of copper or aluminum. Those skilled in the art will recognize that tuning rod 29 is threadably engaged with a top of coaxial cavity 25 to adjust the frequency of coaxial cavity 25 by causing the length of resonator 31 to vary in the directions indicated by arrow 33. The resonant frequency is dependent primarily on the effective length of resonator 31. Resonator 31 has a movable lower portion that is attached to the lower end of tuning rod 29 and slidably electrically contacts a copper sleeve portion 31′ that is attached to the high conductivity inner surface of coaxial cavity 25. In accordance with the present invention, temperature compensating element 21 is attached to the inner surface of housing 27 approximately adjacent to the lower end of resonator 31. Temperature compensating element 21 functions to compensate for thermal expansion and contraction of tuning rod 29 in essentially the manner previously described with reference to square prism filter 1 of FIG. 1.

In all of the embodiments of the invention that I have constructed to date, I have empirically determined the optimum dimensions and placement of the temperature compensating elements 21 in the various tuned cavity devices to attain optimum temperature compensation.

In some instances, it may be desirable to vary or "calibrate" the amount that the inclined portion 21B of a temperature compensating element 21 extends into the interior of a tuned cavity. The arrangement shown in FIG. 4 illustrates a practical way of accomplishing this objective by providing a set screw 35 that extends through a threaded hole from the exterior to the interior of the housing of a tuned cavity and engages the inclined section 21B near its base 21A and spring biases or moves the inclined section 21B in a direction indicated by arrows 22′ into a particular calibrated position.

Figure 4:
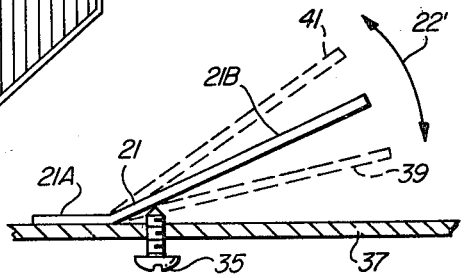
FIG. 4 is a section view of an alternate embodiment of the bi-metallic temperature compensating element shown in FIG. 1A.

Then, as the temperature increases, the bi-metallic inclined section 21B will tend to bend slightly toward the inner surface 37 of the tuned cavity housing, as indicated by dotted lines 39 or as the temperature decreases from the initial temperature, the slight bending of the inclined section 21B will cause it to assume the configuration indicated in FIG. 4 by reference numeral 41, increasing the capacitive loading on the resonant signal in the tuned cavity, tending to decrease the resonant frequency to compensate for thermal contraction of other portions of the tuned cavity.

Figure 5A:
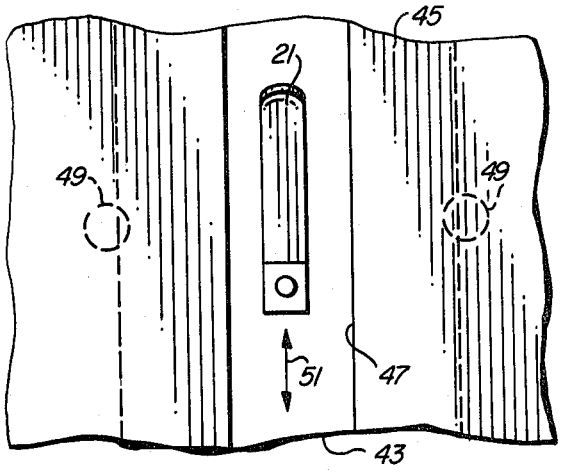
FIG. 5A is a plan view of another embodiment of the present invention.
Figure 5B:
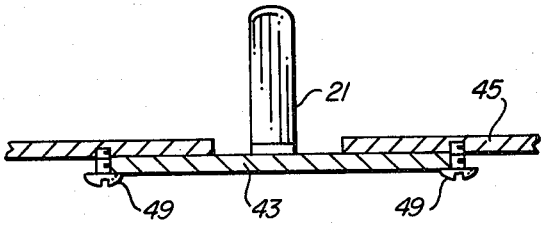
FIG. 5B is an end view of the embodiment of the invention shown in FIG. 5A.
Figure 5C:
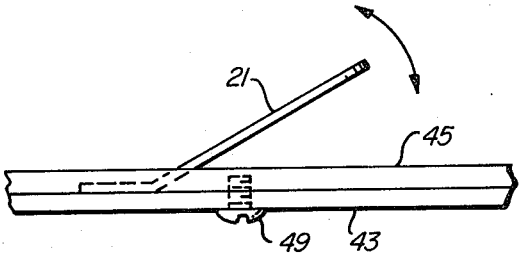
FIG. 5C is a side view of the embodiment of the invention shown in FIG. 5A.

In certain instances, it may be advantageous to be able to laterally vary the position of a temperature compensating element such as 21 in the interior of a tuned cavity. The arrangement shown in FIGS. 5A–5C makes this possible. FIG. 5A shows a temperature compensating element 21 attached to a sliding plate 43 disposed on the outer surface of the housing 45 of the tuned cavity. Temperature compensating element 21 extends from plate 43 into the interior of the tuned cavity through an elongated groove 47. When retaining screws 49 are loosened slightly, plate 43 can be slid in a direction indicated by arrows 51.

While the invention has been described with reference to a particular embodiment thereof, those skilled in the art will be able to provide various modifications to the disclosed structure of the temperature element without departing from the true spirit and scope of the present invention. For example, means for rotating the orientation of the disclosed temperature compensating element 21 parallel to the plane of the surface to which base section 21A is attached from outside of the tuned cavity device could be provided. It is not necessary that the inclined section 21B be perfectly straight. Any configuration that will result in the movement of a substantial portion of the highly conductive temperature compensating element deeper into the interior of the tuned cavity as the temperature decreases will accomplish the desired function as long as good electrical contact with the interior surface of the tuned cavity is maintained. Furthermore, it is not absolutely essential that the bi-metallic element be located inside the tuned cavity, as long as an essentially frictionless connecting means is provided between a bi-metallic element attached on the outside of the tuned cavity and a very high conductivity, flexible strip conductor or the equivalent that is both physically and electrically connected to the high conductivity inner surface of the tuned cavity. In some cases, it could be desirable to provide external means for rotating the orientation of the described bi-metallic strip to adjust its temperature compensating effects.

We claim:

1. A tuned cavity device for producing a resonating standing wave pattern therein, said tuned cavity device comprising in combination:

(a) a housing having a high conductivity inner surface enclosing a region in which said standing wave pattern resonates;

(b) frequency-determining means for determining a resonant frequency of said tuned cavity device, said frequency-determining means having a non-zero thermal expansion coefficient; and (c) bi-metallic temperature compensating means disposed in said region and electrically contacting said inner surface for extending from said inner surface into said region, the amount of said extension of said bi-metallic temperature compensating means increasing and decreasing as the temperature of said tuned cavity device decreases and increases, respectively, to compensate for thermal expansion and contraction of said frequency-determining means as a function of temperature of said tuned cavity device, said bi-metallic temperature compensating means including a strip of bi-metallic material having a first portion attached to a portion of said inner surface and a relatively flat second portion inclined at an acute angle relative to said portion of said inner surface, said strip of bi-metallic material bending with variation in temperature.

2. The tuned cavity device of claim 1 wherein said acute angle is roughly thirty degrees.

3. The tuned cavity device of claim 1 wherein said coating metal is silver.

4. The tuned cavity device of claim 1 wherein said bi-metallic strip is positioned to extend into a relatively high field intensity region of said region.

5. The tuned cavity device of claim 1 wherein said tuned cavity device is a square prism filter.

6. The tuned cavity device of claims 4 or 5 wherein said bi-metallic strip is attached to the center of a wall of said square prism filter.

7. The tuned cavity device of claim 1 wherein said tuned cavity device is a coaxial tuned cavity device having a resonator.

8. The tuned cavity device of claims 4 or 5 wherein said bi-metallic strip is attached to said inner surface relatively close to a free end of said resonator.

9. The tuned cavity device of claim 1 wherein said tuned cavity device is a cubic tuned cavity device.

10. The tuned cavity device of claim 1 including adjustment means for extending from outside of said tuned cavity into said region to contact and spring bias the position of a point of said bi-metallic strip near the junction of said first and second portions thereof in order to calibrate the resonant frequency of said tuned cavity device.

11. The tuned cavity device of claim 1 wherein said strip of bi-metallic material is coated with a relatively high conductivity coating metal to reduce insertion loss due to extension of said bi-metallic material into said volume.

* * * * *